US005736467A

United States Patent [19]

Oken

[11] Patent Number: 5,736,467

[45] Date of Patent: Apr. 7, 1998

[54] WATERPROOF, VAPOR-PERMEABLE FABRIC AND METHOD FOR GENERATING SAME

[76] Inventor: Aaron Oken, 1704 N. Park Dr., #613, Wilmington, Del. 19806

[21] Appl. No.: 618,846

[22] Filed: Mar. 20, 1996

[51] Int. Cl.[6] ..... B32B 7/00

[52] U.S. Cl. ..... 442/26; 442/85

[58] Field of Search ..... 442/85, 86

[56] References Cited

U.S. PATENT DOCUMENTS

| | | | |
|---|---|---|---|
| 2,673,825 | 3/1954 | Biefeld et al. | 154/128 |
| 3,934,587 | 1/1976 | Gordon | 128/284 |
| 4,454,191 | 6/1984 | Von Blücher et al. | 428/244 |
| 4,567,221 | 1/1986 | Maruyama et al. | 524/436 |
| 4,613,544 | 9/1986 | Burleigh | 428/315.5 |
| 4,636,424 | 1/1987 | Amemiya et al. | 428/198 |
| 4,695,484 | 9/1987 | Tanaka et al. | 427/245 |
| 4,863,788 | 9/1989 | Bellairs et al. | 428/246 |
| 5,137,954 | 8/1992 | Das Gupta et al. | 524/284 |
| 5,204,403 | 4/1993 | Furuta et al. | 324/493 |
| 5,358,780 | 10/1994 | Kafchinski et al. | 428/284 |
| 5,380,588 | 1/1995 | Nishiyama et al. | 428/364 |

*Primary Examiner*—James J. Bell
*Attorney, Agent, or Firm*—Ratner & Prestia

[57] ABSTRACT

A method for generating a waterproof, vapor-permeable fabric, wherein a coating liquid is applied to a fabric. The coating liquid comprises a solvent medium and a polyvinylacetal which is an acid-catalyzed reaction product of polyvinyl alcohol and one or more aldehydes, ketones or combinations thereof, wherein each aldehyde contains 1 to 18 carbon atoms and each ketone contains 3 to 16 carbon atoms, and wherein about 1% to about 40% of hydroxyl groups on the polyvinyl alcohol are converted to acetal structures. Once the coating liquid is applied, the solvent medium is removed to form the coated fabric.

8 Claims, No Drawings

WATERPROOF, VAPOR-PERMEABLE FABRIC AND METHOD FOR GENERATING SAME

BACKGROUND OF THE INVENTION

1. Field of the Invention

This invention relates to a waterproof fabric which is highly permeable to water vapor. More specifically, the present invention a method for combining a textile with a polymer such that the textile becomes moisture permeable but liquid water impermeable.

2. Description of Related Art

The invention of the vulcanization of rubber more than a century ago began the development of coated fabrics and waterproof apparel, and initiated years of research designed to try to overcome the discomfort attendant upon their wear. Even when the body is at rest, the skin perspires, and this continuous production of moisture must be evaporated to control body temperature and to provide a feeling of comfort. However, traditional waterproofing coatings do not allow such evaporation, and as a result, those wearing such waterproof garments are often drenched in their own sweat, even in cold weather. Accordingly, attempts have been made to replace these waterproof fabrics with more vapor-permeable types of coated fabrics. Some of these attempts include coating certain fabrics with lighter-weight coatings of newer materials such as polyvinylchloride, polyacrylates and polyurethanes. In fact, fabrics with such coatings, despite their very low moisture permeability, serve a large part of the rainwear market today due to their low cost. These coatings, however, suffer greatly from their lack of vapor-permeability, and the problem of wearer discomfort remains.

As such, attempts have been made to correct this comfort problem. These attempts have generally gone one of two directions. The first seeks by various means to create pores in the polymer coating which are so small that droplets of water cannot penetrate, but which are amply large for water vapor to diffuse through. Typical examples of these polymer coatings can be seen in the disclosures of U.S. Pat. Nos. 5,204,403, 5,358,780 and 4,863,788. Unfortunately, the complex processes involved in creating these perforated coatings tends to substantially weaken the polymer film. As a result, the wear resistance of the garment is greatly decreased.

The second approach avoids altogether the process of applying a coating layer directly to the textile substrate. Instead, the textile is laminated with a separately formed microporous polymer sheet. This type of technology can be seen U.S. Pat. Nos. 4,194,041, 4,443,511 and 4,613,544. However, this microporous sheet technology suffers from, among other things, high cost. For example, the microporous sheet, often polytetrafluoroethylene, is itself expensive. Furthermore, since this thin sheet is very fragile, a textile covering must be laminated with a suitable adhesive to both sides of the film. Add to the cost a complex production process and output that often shows an undesirable boardy "hand" and a distressing tendency to delaminate, and it is not surprising that garments of such laminates are often priced at ten times the price of products made from coated fabric.

Therefore, there is a need for an inexpensive, durable, simple method to make a waterproof fabric which has high vapor permeability.

SUMMARY OF THE INVENTION

These needs are met by the coating method and the coated fabric in accordance with the present invention which is a method for generating a waterproof, vapor-permeable fabric, comprising the steps of:

A. applying a coating liquid to a fabric, the coating liquid comprising:
   1) a solvent medium; and
   2) a polyvinylacetal which is an acid-catalyzed reaction product of polyvinyl alcohol and one or more aldehydes, ketones or combinations thereof, wherein each aldehyde contains 1 to 18 carbon atoms and each ketone contains 3 to 16 carbon atoms, and wherein about 1% to about 40% of hydroxyl groups on the polyvinyl alcohol are converted to acetal structures; and B. removing the solvent medium to form a coated fabric.

Another embodiment of this invention is a waterproof, vapor-permeable coated fabric comprising:

A. a fabric and, coated thereon,

B. a polyvinylacetal which is an acid-catalyzed reaction product of polyvinyl alcohol and at least one aldehyde, ketone, or combinations thereof, wherein each aldehyde contains 1 to 18 carbon atoms and each ketone contains 3 to 16 carbon atoms, and wherein about 1% to about 40% of hydroxyl groups on the polyvinyl alcohol are converted to acetal structures.

DESCRIPTION OF THE PREFERRED EMBODIMENT(S)

For those having skill in the art of polymer chemistry, it is well known that the permeability of a polymer to a gas (e.g. water vapor) is related to the solubility of the polymer in the corresponding condensed phase (water). It follows that a polymer which is infinitely soluble in water should, in its anhydrous state, display extremely high permeability to water vapor. Polyvinyl alcohol is one such completely water soluble material and this invention discloses a novel process for making, from the polyvinyl alcohol, a textile coating which is impermeable to liquid water but permeable to the passage of water vapor.

Generally, in this invention, a coating is made which has a composition comprising the reaction product of polyvinyl alcohol with aliphatic aldehydes and/or ketones in such a way that up to 40% of the hydroxyl groups of the polyvinyl alcohol are converted to acetal structures. This reaction product is dissolved or dispersed in a solvent medium. Once dissolved, the composition is coated onto any of a variety of textile products. The coated textile is oven dried (thus removing the solvent medium) resulting in a waterproof, vapor-permeable textile or fabric.

The novel process of this invention utilizes two essential components, one being polyvinyl alcohol, and the other being either an aldehyde, a ketone, or combinations of both. These two essential components are combined in an acid catalyzed reaction where they form an acetal. After the reaction is completed, a stable solution or dispersion of the acetal is applied directly to a textile substrate and dried, whereby the waterproof, vapor-permeable fabric of the present invention is produced.

The first reagent, polyvinyl alcohol, is the hydrolysis product of polyvinyl acetate, and is available from commercial sources in a number of grades. These grades differ in percentage of residual acetate and in viscosity. In the preferred embodiment, the product grade contains less than 3% of acetate remnants, however, any of the differing grades can be used in this invention including polyvinyl alcohol with no acetate remnants. Although the viscosity is not critical, typically the viscosity grade should be chosen according to the viscosity and percent solids desired in a specific coating formulation. For example, an acetal from VINOL 107 polyvinyl alcohol when diluted to 11% solids has a viscosity of 2000 cp. The parent polyvinyl acetate from which the polyvinyl acetal is prepared may display an intrinsic viscosity as a molar solution in benzene of not less than 7 cp at 60° C. and may be as high as 45 cp at 60° C.

The second essential reagent in this invention is one or more aldehydes, one or more ketones or a combination thereof. As is well known in the art, aldehydes and ketones are polar compounds and, at lower molecular weights, aldehydes and ketones are appreciably soluble in water as well as most organic solvents.

In the present invention, an aldehyde containing 1 to 18 carbon atoms or a ketone containing 3 to 16 carbon atoms are both suitable for preparing the acetal. Preferably, each aldehyde and/or ketone contains between 6 to 12 carbon atoms. Suitable aldehydes for use in forming the acetal include formaldehyde acetaldehyde, propionaldehyde, n-butyraldehyde, isobutyraldehyde, n-valeraldehyde, isovaleraldehyde, n-caproaldehyde, n-heptaldehyde, stearaldehyde, benzaldehyde or combinations thereof. Suitable ketones include acetone, methyl ethyl ketone, methyl n-propyl ketone, diethyl ketone, hexanone-2, hexanone-3, methyl t-butyl ketone, di-n-propyl ketone, diisopropyl ketone, diisobutyl ketone, cyclohexanone or combinations thereof, The reaction product of polyvinyl alcohol with either an aldehyde or ketone is an acetal. The acetal formed is of the formula:

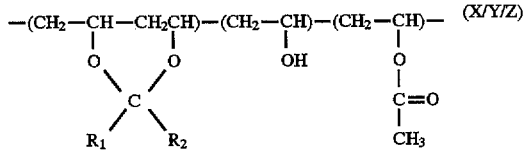

(X/Y/Z)

Wherein $R_1$ is an alkyl or aryl group; $R_2$ is Hydrogen or an alkyl group; with the proviso that when $R_1$ and $R_2$ are alkyl groups, $R_1$ and $R_2$ together may form a Cyclic Ring; and X is 1–40 mole % of the acetal polymer;

Y is 60–98 mole % of the acetal polymer; and

Z is 0–3 mole % of the acetal polymer.

The total number of carbons in the alkyl group ranges from 1 to 18 for an aldehyde and 3 to 16 for a ketone. There are several moieties which may exist in these acetals depending on the type of aldehyde and/or ketone used as well as the reaction parameters used. In addition, in each case, the polymer moieties X,Y and Z are randomly distributed throughout the chain of the polyvinyl acetal.

The decision on whether to use an aldehyde, ketone or combination thereof will depend upon the specific properties needed for specific applications which can only be determined for each particular use of the coating.

However, one factor in the choice of aldehyde and/or ketone is the solubility of the aldehyde/ketone in the reaction mixture. It is desirable, but not essential, that the aldehyde/ketone be fairly soluble in a reaction medium which may contain water in order to facilitate the reaction between the aldehyde/ketone and the polyvinyl alcohol. I have found that octanal, decanal, dodecanal and cyclohexanone are the preferred members of this reagent group.

The quantity of aldehyde and/or ketone reacting with the polyvinyl alcohol is the important variable in this process. I have found that useful products are obtained when less than about 40% of the available hydroxyl groups are converted to acetal structures, with a preferred range of conversion being between about 2 to about 20 percent. The following formula may be used to calculate the quantity of aldehyde/ketone used with a given weight of polyvinyl alcohol:

W=the weight of polyvinyl alcohol

P=the percent of hydroxyl groups to be converted

M=the molecular weight of the aldehyde and/or ketone

Q=the weight of aldehyde and/or ketone required $$Q=(W/88)\times(P/100)\times M$$

In order to form the acetal described above, the polyvinyl alcohol and the aldehyde/ketone must react in a medium. In the preferred embodiment of the present invention, the medium for the reaction is predominantly water because polyvinyl alcohol is completely soluble only in water. Nevertheless, in this embodiment, if desired, water miscible solvents such as lower alcohols (e.g. methanol) or etheralcohols, if introduced slowly and with good dispersion, can be added to aqueous solutions of polyvinyl alcohol to the limit that precipitates the polyvinyl alcohol. In addition, when the medium consists essentially of water, the water miscible solvent typically is selected from the group consisting of $C_1$ to $C_6$ alkanols, alkoxyalkanols, and mixtures thereof. In the preferred embodiment, a maximum level of organic solvent is included in the reaction medium in order to retain the water insoluble acetal reaction product in solution for direct application to the textile substrate. If the acetal reaction product is to be isolated, a reaction in a purely aqueous medium will precipitate the product directly.

The acetal reaction product coating composition typically is prepared by first dissolving the polyvinyl alcohol with heating and agitation, in a mixture of water and methanol. The reaction between the polyvinyl alcohol and the aldehyde in the solvent medium, which forms the acetal, is acid catalyzed. Accordingly, after the polyvinyl alcohol is dissolved, and prior to the reaction, 0.1% to 0.5% of an acid, preferably concentrated hydrochloric acid, is added to the reaction mixture. The aldehyde is then added to the mixture to initiate the reaction. The concentrations typically are such that the stoichiometry will give a product with fewer than 20% of the hydroxyl groups converted to acetal groups. In addition, depending upon which aldehyde or ketone is used, as well as the proportion of solvent and water used in the reaction, a product can be obtained with up to 40% of the hydroxyl groups converted to acetal groups.

The reaction proceeds at room temperature but can be accelerated by heating using a reflux condenser to prevent loss of the medium. The progress of the reaction can be followed by withdrawing a small sample of the reaction mixture, casting and drying a film and examining the film sample with an infra-red spectrophotometer. The disappearance of the carbonyl band of the aldehyde signals the completion of the reaction. Upon completion of the reaction, the solution is cooled to room temperature.

At this point, the solution can be used without further modification or, if desired, various additives may be added to the room temperature solution. To enhance the resistance of the applied coating to water, solvents, and abrasion, the addition of cross-linking agents may be employed. Products based on condensates of formaldehyde with phenol, urea and melamine are well known and useful for this purpose. It has been determined that at 0.5% to 5% concentration, a commercial product based on melamine which is stable and unreactive in the coating solution becomes reactive at the temperature at which the coated fabric is dried.

The coating of the present invention can be applied to a variety of substrates including such woven fabrics as rayon, nylon, polyester, acrylic and mixtures thereof, as well as natural fibers such as cotton or cotton/polyester blends. In addition, nonwoven fabrics of nylon, polyester and the like can be used as well as fiber products such as wood, paper, cardboard and the like, After application of the coating to the substrate, it is dried to remove the solvent medium and to assist in adhering the coating to the substrate. The drying process is preferably done by heating the coated substrate.

Once the coated substrate is dried, the coating itself is practically invisible on the substrate. Pure films are colorless, transparent and flexible, thus providing a very effective coating for textiles and fabrics in terms of applicability and durability.

The physical properties of polyvinyl alcohol are changed dramatically by the partial acetalization. Whereas anhydrous films of polyvinyl alcohol are stiff and brittle, modifications that convert as little as 3% of the hydroxyl groups into acetal structures are water insoluble, flexible and extensible. This property of the product film is a function of both the molecular weight of the aldehyde/ketone and of the percentage of the hydroxyl groups that are converted in the product. The films tightly adhere to glass and textiles and cannot be removed by a conventional Scotch tape test. Immersion in water does not dissolve the dried films.

The invention is illustrated by the following examples, but is not intended to be limited thereby:

EXAMPLE 1

100 grams of Vinol 107 polyvinyl alcohol (Air Products and Chemical Co.) was dissolved in a mixture of 365 ml of water and 195 ml of methanol by heating with good agitation. When the polymer was completely dissolved, an additional 195 ml of methanol was added slowly over one hour with vigorous mixing to avoid local concentrations of methanol which precipitates the polymer, followed by 10 grams of 2-ethylhexanal and 3 ml of concentrated hydrochloric acid. This stoichiometry gave a product with 7% of the hydroxyl groups converted to acetal groups. When more than 10 grams of 2-ethylhexanal was added, the product polymer precipitated from this alcohol-water mixture. After 7 hours of refluxing, an infrared test was run on the cast film showing no carbonyl band, and the solution was cooled to room temperature. The solution viscosity was adjusted to 2000 cp by adding 150 ml of a 60% mixture of methanol-water to give an 11% solids content, and finally 1 gram of Cymel 303, hexamethoxymethylmelamine (American Cyanamide Co.) was added. This final product, a stable solution, slightly cloudy when chilled, was applied directly to a textile substrate, namely ripstop nylon. Dried films cast from the polymer solution were clear, strong, flexible and water insoluble.

The above solution was coated onto a substrate of ripstop nylon by drawdown with a wirewound rod, and oven dried at 90° C. The moisture permeability of the coating was compared to the uncoated nylon and to a sample cut from a popular laminated garment. A measured ounce of water was placed into a Mason jar and then a fabric disc was sealed onto a rubber gasket on the top of the jar with a screw cap from which the metal center has been removed. The jars were placed together on a thermostated electric warming tray. Under these conditions, the time to complete evaporation of the water was as follows:

Uncoated ripstop nylon . . . 11 hours
Coated ripstop nylon . . . 26 hours
Commercial waterproof laminate . . . 72 hours.

The water resistance was tested by sealing the fabric sample to a water filled Mason jar with the coated side against the water. The jar was inverted and watched for drips through the fabric. After 8 hours, no water had penetrated the fabric.

EXAMPLE 2

A reaction similar to example 1 with 140 g of polyvinyl alcohol and 14 g of acetaldehyde yielded a solution of partial acetal with 20% of the hydroxyl groups converted. To this solution was added 1.5 g of Cymel 303 and the solution applied to fabric as above. Again, a water insoluble coating was formed which was highly permeable to water vapor.

EXAMPLE 3

140 g of polyvinyl alcohol was dissolved in a mixture of 715 ml of water and 275 ml of methanol. To this was added 11.5 g of hexadecyl aldehyde and 4 ml of concentrated HCL to convert 3% of the hydroxyl groups to acetals. After several hours of refluxing the product polymer was filtered from the solution, redissolved in dioxane to form a 10% solution and applied to fabric. The moisture vapor transmission was at least as high as example 1, and in some cases substantially higher. The dried polymer film was insoluble in water.

EXAMPLE 4

688 grams of polyvinyl acetate (viscosity of 45 cp at 60° C. dissolved in benzene) was dissolved in 3200 ml of methanol and 800 ml of 4.6 normal methanolic hydrochloric acid. The reaction produced a water soluble product in 2½ hours. 78.4 grams of cyclohexanone was added to the solution and the solution was then allowed to stand for 18 hours until an infra-red scan showed minimal carbonyl groups. 10% of the hydroxyl groups were converted to acetal groups. This solution was applied to fabric and tested in the same manner as described in Example 1. The resulting fabric provided a water vapor permeable but water impenetrable coated fabric.

Those skilled in the art having the benefit of the teachings of the present invention as hereinabove set forth, can effect numerous modifications thereto. These modifications are to be construed as being encompassed within the scope of the present invention as set forth in the appended claims.

I claim:

1. A waterproof, vapor-permeable coated fabric comprising:

A. a fabric and, coated thereon,

B. a polyvinylacetal which is an acid-catalyzed reaction product of polyvinyl alcohol and at least one aldehyde, ketone, or combinations thereof, wherein each aldehyde contains 1 to 18 carbon atoms and each ketone contains 3 to 16 carbon atoms, and wherein about 1% to about 40% of hydroxyl groups on the polyvinyl alcohol are converted to acetal structures.

2. The coated fabric of claim 1 wherein the polyvinylacetal is crosslinked.

3. The coated fabric of claim 1 wherein the polyvinyl alcohol contains up to about 3% pendant acetate groups.

4. The coated fabric of claim 1 wherein each aldehyde contains 6 to 12 carbon atoms.

5. The coated fabric of claim 1 wherein each ketone contains 6 to 12 carbon atoms.

6. The coated fabric of claim 1 wherein about 2% to about 20% of the hydroxyl groups on the polyvinyl alcohol are converted to acetal structures.

7. The coated fabric of claim 1 wherein the fabric is a woven or nonwoven fabric.

8. The coated fabric of claim 1 wherein the fabric is a paper product.

* * * * *